United States Patent [19]

Mott

[11] Patent Number: 4,596,908

[45] Date of Patent: Jun. 24, 1986

[54] SAFETY COVER FOR AN ELECTRICAL OUTLET

[76] Inventor: John S. Mott, 117 S. Miranda, Las Cruces, N. Mex. 88005

[21] Appl. No.: 708,488

[22] Filed: Mar. 5, 1985

[51] Int. Cl.[4] ..... H01R 33/96

[52] U.S. Cl. ..... 200/51.09

[58] Field of Search ..... 200/51.09, 51.12, 51.13

[56] References Cited

U.S. PATENT DOCUMENTS

| | | | |
|---|---|---|---|
| 3,263,037 | 7/1966 | Correnti | 200/51.09 |
| 3,801,757 | 4/1974 | Carissimi et al. | 200/51.09 |
| 3,843,854 | 10/1974 | Mori et al. | 200/51.09 |

FOREIGN PATENT DOCUMENTS

| | | | |
|---|---|---|---|
| 437309 | 10/1935 | United Kingdom | 200/51.09 |

*Primary Examiner*—Stephen Marcus

*Assistant Examiner*—Renee S. Luebke

*Attorney, Agent, or Firm*—Richards, Harris, Medlock & Andrews

[57] ABSTRACT

A cover assembly is provided for safely interconnecting a line plug with an electrical outlet box. A base plate (50) is provided with connectors (64, 62) for engaging a conventional household power supply. Electrically conductive strips (56) on the base plate (50) are energized through the connectors (64, 62). Receptacles (40) have conductive contact arms (46) spaced above the conductive strips (56). A tumbler (30) rotates about receptacle (40) for establishing a breakable electrical connection (35) between the base plate (50) and the receptacle contact arms (46). A key (10) engages and rotates a tumbler (30) to electrically disconnect the tumbler (30) from the base plate (50) before a line plug can be inserted or removed from a receptacle (40).

8 Claims, 2 Drawing Figures

SAFETY COVER FOR AN ELECTRICAL OUTLET

TECHNICAL FIELD

This invention relates to safety devices and more particularly relates to electrical safety devices preventing access to energized components.

BACKGROUND ART

There is today a growing awareness of safety in the design of many consumer products and particularly consumer products which are accessible by children. For example, medicine containers are required to incorporate features which require eye-hand coordination generally beyond the capability of a child who cannot understand the dangerous nature of the medicine. Toy products are required to have attachments which may not be swallowed, do not inflict wounds, or otherwise be susceptible to cause injury even if misused.

Most households, however, include a large number of electrical outlets which deliver dangerous voltage and current at areas near the floor surface which are readily accessible to children. Nonconductive plugs are available to prevent access to the electrical power lines where the outlet is not in use. When a line plug is inserted in the receptacle for use, a generally nonconductive external configuration is created. However, the plug may become loose and expose internal conductive energized prongs and wiring. A child may attempt to remove the plug from the receptacle to expose plug prongs which are energized. It would be desirable to prevent access to the plugs by a child, or to prevent removal of the plug by a child, or to deenergize the plug prior to enabling removal of the plug from the receptacle.

The disadvantages of the prior art are overcome by the present invention, however, and an improved electrical outlet is provided to afford a safe connection between the electrical outlet and an external line plug.

SUMMARY OF THE INVENTION

In a preferred embodiment of the present invention, a cover is provided for safely interconnecting a line plug with an electrical outlet box. A base plate is provided for interconnecting with a household power supply. At least one electrically conductive strip on the base plate forms a predetermined pattern on the plate and is energized by the household power source.

A receptacle is fixed above the base plate with at least one conductive contact arm spaced above the respective conductive strip. The receptacle is energized through a tumbler rotatable about the receptacle and having a resilient contact for establishing a breakable electrical connection between the conductive strip on the base plate and the conductive contact arm on the receptacle.

A key is provided for engaging and rotating the tumbler to break the electrical connection between the tumbler and the base plate before inserting or removing the line plug from the receptacle.

These and other features of the present invention will become apparent from the following detailed description, wherein reference is made to the figures in the accompanying drawings.

DETAILED DESCRIPTION

Figure 1:
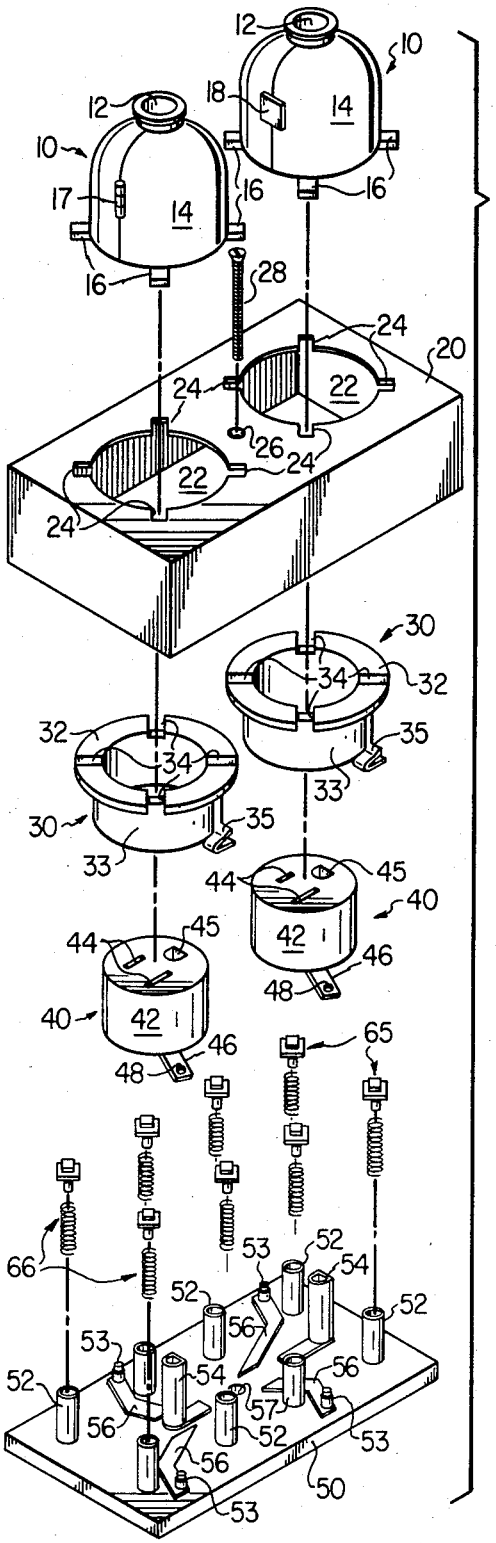
FIG. 1 is an exploded view illustrating one embodiment of the present invention.

Referring now to FIG. 1, there is shown a preferred embodiment of the component parts of the present invention in exploded relationship. A line cord terminating in a conventional plug cannot be energized until the plug is properly retained by the structure shown in FIG. 1. Likewise, the plug is necessarily deenergized before the plug can be removed from the electrical outlet.

Safety key 10 is provided for accommodating the line cord and the plug (not shown). The line cord extends through cord opening 12, and body halves 14 of safety key 10 have a hinged connection 17 enabling body halves 14 to be opened, placed about the line cord plug and closed about the plug. Closure latch 18 holds body halves 14 together about the line cord plug.

Key tabs 16 depend from body halves 14. Tabs 16 are preferably spaced at 90° intervals about the periphery of safety key 10. Tabs 16 extend beneath the perimeter of body halves 14 to provide an unlocking function, hereinbelow discussed. Cover plate 20 encloses the interior components and defines key openings 22 and key tab reception slots 24. Slots 24 are configured to admit tabs 16 through cover plate 20. The diameter of key opening 22 is adequate to accept the diameter of assembled body halves 14.

Key tumbler 30 is provided within cover plate 20 for cooperative action with safety key 10. Key tumbler 30 has a circumferential lip 32 on a body portion 33. Circumferential lip 32 defines grooves 34 which mate with key tabs 16. Key tabs 16 fit within grooves 34 as the bottom perimeter of body halves 14 rests on lips 32.

Body 33 of tumbler 30 includes an attached electrical connector 35. Electrical connector 35 is preferably of copper and is attached to body 33. In a preferred embodiment, contact 35 is resilient and may be formed of a copper strip in a "V" configuration for making good electrical connection.

Key tumbler 30 is placed about receptacle 40. Receptacle 40 includes body portion 42 mounted on contact arms 46. There is at least one contact arm 46 and preferably a pair of contact arms 46, each having a mounting hole 48. Body 42 defines prong receptacles 44, at least one of which is connected to a corresponding contact arm 46. Body 42 also defines a ground wire connecting hole 45 therethrough.

Figure 2:
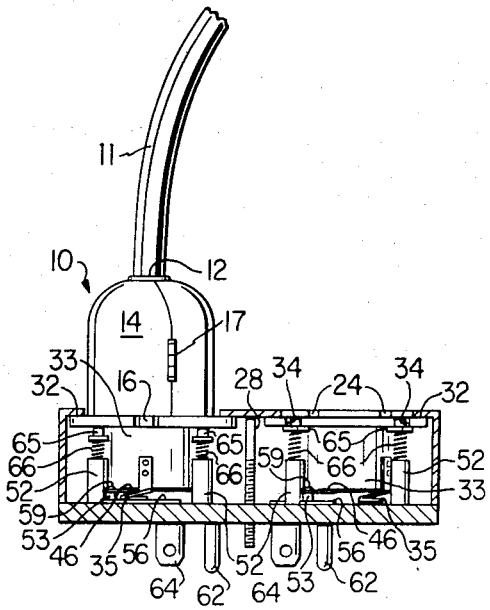
FIG. 2 is an exposed side view illustrating the assembled relationship of components depicted in FIG. 1.

Base plate 50 is provided for forming the electrical interconnections to provide power through contact arms 46 and receptacles 44 to the connected line plug. Mounting pins 53 engage mounting holes 48 on contact arms 46 of receptacle 40 to space contact arm 46 above the surface of base plate 50. Base plate 50 also provides mounting cylinders 52 for safety pins 65 and bias spring 66. As shown in FIG. 2 spring 66 biases pin 65 upwardly against circumferential lip portions of tumbler 30. When grooves 34 are aligned with reception slots 24 in cover plate 20, safety pins 65 are engaged within grooves 34 to maintain tumbler 30 in an orientation effective to break the electrical contact between the power supply and contact arms 46 of receptacle 40.

Base plate 50 may also conveniently provide neutral contact inserts 54 for engaging ground receptacle holes 45 in body 42 of receptacle 40. This maintains continuous ground wire connection for safety purposes when connector 35 of tumbler 30 is rotated out of electrical contact with receptacle 40.

As shown in FIG. 1, base plate 50 includes contact strips 56 formed on one surface of base plate 50. The embodiment shown in FIG. 1 is configured to connect contact strips 56 with prongs on the opposite side of base plate 50 which are conventionally configured to insert in a typical (household) electrical outlet. However, contact strips 56 might be configured to mate directly with electrical wiring for hardwiring base plate 50 into an electrical distribution system.

In assembly, cover plate 20 is assembled over tumbler 30, receptacle 40 onto base plate 50. Assembly screw 28 provides a removable assembly, extending through screw hole 26 and through base plate screw hole 57. Assembly screw 28 connects cover plate 20 to the underlying electrical outlet.

Referring now to FIG. 2 there is shown an assembly of components. Line cord 11 terminates in a line plug (not shown) contained within safety key 10. Opening 12 is provided to exit line cord 11 and to allow safety key 10 to slide along line cord 11 when safety key 10 is not inserted into cover plate 20. Body halves 14 are connected by hinge 17 and are illustrated in a closed condition surrounding the line plug (not shown). The interior volume defined by body halves 14 accommodates conventional line plugs but does not enable a line plug to be disengaged from receptacle 40 when safety key 10 properly engages tumblers 30 (FIG. 1).

The left half of FIG. 2 depicts body halves 14 resting on lip 32 with key tab 16 engaging mating grooves 34. Tumbler body 33 has been rotated to bring resilient contact 35 into electrical connection between contact strips 56 and contact arms 46. The "V" shape enables contact 35 to exert contact pressure against both contact strips 56 and contact arms 46 for good electrical contact.

When key tab 16 is inserted within groove 34, safety pins 65 are moved beneath the bottom surface of lip 32 to enable tumbler body 33 to be rotated. When grooves 34 move from above safety pins 65, bias springs 66 urge pins 65 against the bottom surface of lip 32 to provide frictional contact between lip 32 and cover plate 20 to maintain the desired locking orientation.

When the assembly is in the configuration shown in FIG. 2, left hand side, electrical power is transmitted from the electrical outlet to line cord 11. In a preferred embodiment, conventional outlet prong 64 with ground prong 62 engage the wall outlet. As noted above, base plate 50 could be hard wired to existing wiring rather than providing conventional prongs 64, 62.

Contact arms 46 are mounted on pins 53 for holding receptacle 40 (FIG. 1) above base plate 50. Tumbler body 33 rotates around receptacle 40. The assembly may be conveniently secured by holding cap 59 (FIG. 2) which may be a rivet or may be molded from mounting pin 53 or may be a removable "C" ring.

Electrical contact is established through a prong 64, along contact strip 56, through resilient connector 35 to contact arm 46. Contact arm 46 is in electrical connection with a prong receptacle 44 of receptacle 40 (FIG. 1) and, through the inserted plug line (not shown) to line cord 11.

FIG. 2, right hand portion, illustrates the internal configuration when a line plug is removed. Safety pins 65 engage grooves 34 in circumferential lip 32 when grooves 34 are aligned beneath key tab reception slots 24. In this orientation of tumbler body 33 "V" contacts 35 have moved from between contact arms 46 and contact strips 56 and no continuous path exists to energize receptacle 40 (FIG. 1). Safety pins 65 assure that unintentional rotation of tumbler body 33 does not occur to establish inadvertent electrical contact.

From the above description, it is apparent that the safety cover herein described greatly reduces the chance of any contact with energized portions of an electrical outlet. When an electrical plug is removed from the safety cover, the internal receptacle is deenergized. Thus, when a line plug is first inserted in the receptacle, the line cord is not energized. To energize the line cord, the plug must first be enclosed within safety key 10 and safety key 10 rotated to bring "V" connectors 35 between contact strips 56 and contact arms 46. When this occurs, however, safety key 10 is retained beneath cover 20 and the line plug is retained within safety key 10. Thus, the line plug cannot be accessed or removed while energized.

Safety key 10 can only be removed from around the enclosed line plug by rotating key tab 16 into alignment with reception slots 24 in cover plate 20. In this orientation receptacle 40 is deenergized, as discussed above. Then safety key 10 can be removed from beneath cover plate 20 and freely retracted along base cord 11 to allow release of the line plug and cord 11.

It is therefore apparent that the present invention is one well adapted to attain all of the objects and advantages hereinabove set forth together with other advantages which become obvious and inherent from a description of the apparatus itself. It will be understood that certain combinations and subcombinations are of utility and may be obtained without reference to other features and subcombinations. This is contemplated by and is within the scope of the present invention.

I claim:

1. A safety cover assembly for connecting an electrical line plug to an electrical outlet, comprising:

a base plate having at least one conductive strip in a pattern on said base plate effective to form an electrical connection with said outlet;

a fixed plug receptacle for accepting said line plug and having at least one conductive contact arm spaced from said at least one conductive strip, a tumbler rotatable about said receptacle and having resilient conductive means forming a breakable electrical connection between said conductive contact arm and said conductive strip, and key means for rotating said tumbler and breaking said electrical connection to enable removal of said line plug from said receptacle, said key means further including an enclosure box defining a slotted key pattern therethrough, said tumbler defining a plurality of grooves in a pattern alignable with said slotted key pattern, and an enclosure key with depending tabs corresponding to said slotted key pattern and effective to engage said grooves and rotate said tumbler within said enclosure box.

2. The safety cover assembly of claim 1, wherein said enclosure key includes two exterior shells in hinged relationship and defining a volume effective to enclose said line plug.

3. The safety cover assembly of claim 1, further including a plurality of pins biased toward said slotted key pattern for engaging said grooves of said tumbler when said grooves are aligned with said slotted key pattern.

4. The safety cover assembly of claim 3, wherein said tabs are effective to disengage said pins from said grooves for rotation of said tumbler.

5. The safety cover assembly of claim 1, wherein said enclosure key defines a volume effective to retain said line plug in said receptacle when said electrical connection is made between said electrical contact arm and said conductive strip.

6. The safety cover assembly of claim 5, wherein said enclosure key includes two exterior shells in hinged relationship and defining a volume effective to enclose said line plug.

7. The safety cover assembly of claim 5, further including a plurality of pins biased toward said slotted key pattern for engaging said grooves of said tumbler when said grooves are aligned with said slotted key pattern.

8. The safety cover assembly of claim 7, wherein said tabs are effective to disengage said pins from said grooves for rotation of said tumbler.

* * * * *